US009191746B2

(12) United States Patent
Jenq

(10) Patent No.: US 9,191,746 B2
(45) Date of Patent: Nov. 17, 2015

(54) LOUDSPEAKER DRIVER WITH DUAL ELECTROMAGNET ASSEMBLIES

(76) Inventor: Cheng Yih Jenq, Piscataway, NJ (US)

( * ) Notice: Subject to any disclaimer, the term of this patent is extended or adjusted under 35 U.S.C. 154(b) by 0 days.

(21) Appl. No.: 13/593,736

(22) Filed: Aug. 24, 2012

(65) Prior Publication Data

US 2014/0056466 A1 Feb. 27, 2014

(51) Int. Cl.

| | |
|---|---|
| ***H04R 25/00*** | (2006.01) |
| ***H04R 9/06*** | (2006.01) |
| ***H04R 1/24*** | (2006.01) |
| ***H04R 1/40*** | (2006.01) |

(52) U.S. Cl.

CPC ..... *H04R 9/063* (2013.01); *H04R 1/24* (2013.01); *H04R 1/403* (2013.01)

(58) Field of Classification Search

USPC ..... 381/182, 401, 186, 335

See application file for complete search history.

(56) References Cited

U.S. PATENT DOCUMENTS

| | | | | | |
|---|---|---|---|---|---|
| 1,808,149 | A | * | 6/1931 | Smith | 381/401 |
| 1,862,582 | A | * | 6/1932 | Schlenker | 381/166 |
| 2,926,221 | A | * | 2/1960 | Kagdis | 381/401 |
| 3,125,181 | A | | 3/1964 | Pawlowski | |
| 3,686,446 | A | | 8/1972 | Manger | |
| 3,937,905 | A | * | 2/1976 | Manger | 381/421 |
| 4,016,953 | A | * | 4/1977 | Butler | 381/89 |
| 4,057,689 | A | | 11/1977 | Stallings, Jr. | |
| 4,554,414 | A | | 11/1985 | House | |
| 5,119,431 | A | | 6/1992 | Hamby | |
| 5,255,321 | A | * | 10/1993 | Murray et al. | 381/71.7 |
| 5,590,214 | A | | 12/1996 | Nakamura | |
| 5,742,696 | A | | 4/1998 | Walton | |
| 5,781,645 | A | | 7/1998 | Beale | |
| 5,894,524 | A | | 4/1999 | Kotsatos et al. | |
| 6,108,433 | A | | 8/2000 | Norris | |
| 7,016,508 | B1 | | 3/2006 | Phelps | |
| 7,224,808 | B2 | | 5/2007 | Spencer et al. | |
| 2004/0240697 | A1 | | 12/2004 | Keele, Jr. | |
| 2005/0281413 | A1 | | 12/2005 | Croft, III | |
| 2006/0153407 | A1 | | 7/2006 | Keele et al. | |
| 2006/0204016 | A1 | | 9/2006 | Pham et al. | |
| 2007/0165878 | A1 | | 7/2007 | Konagai | |
| 2011/0182440 | A1 | | 7/2011 | Jenq | |
| 2011/0182449 | A1 | | 7/2011 | Jenq | |

FOREIGN PATENT DOCUMENTS

| | | |
|---|---|---|
| GB | 2418559 | 3/2006 |

OTHER PUBLICATIONS

European Search Report for European Application No. 13181072; dated Jul. 29, 2015; eleven (11) pages.

* cited by examiner

*Primary Examiner* — Davetta W Goins
*Assistant Examiner* — Amir Etesam
(74) *Attorney, Agent, or Firm* — Gerald E. Hespos; Michael J. Porco; Matthew T. Hespos

(57) ABSTRACT

Loudspeaker drivers are provided. According to one embodiment, a loudspeaker driver comprises a diaphragm, a connection tube, first and second voice coils, and first and second magnet assemblies. The connection tube has a first end section, a second end section, and a middle section. The first voice coil is connected to and surrounds at least a portion of the first end section. The second voice coil is connected to and surrounds at least a portion of the second end section. The first magnet assembly is configured to suspend the first voice coil in a first magnetic field and the second magnet assembly is configured to suspend the second voice coil in a second magnetic field. The connection tube intersects the diaphragm and the middle section of the connection tube is connected to the diaphragm.

18 Claims, 2 Drawing Sheets

LOUDSPEAKER DRIVER WITH DUAL ELECTROMAGNET ASSEMBLIES

TECHNICAL FIELD

The present disclosure relates generally to loudspeaker drivers, and more particularly, to loudspeaker drivers including two electromagnetic structures.

BACKGROUND

Loudspeakers have been used for years for providing audio output to listeners. Electrical signals that are representative of various characteristics of sounds are transformed by the loudspeakers into vibrating movements of a diaphragm. These movements of the diaphragm create sound waves that can be heard by those nearby. Typically, the diaphragm of the loudspeaker is formed in the shape of a cone and audio waves are emanated from the cone in the general direction where the open end of the cone is pointed.

A loudspeaker typically employs a voice coil that is wrapped around a hollow cylinder or tube, made of such material as paper, aluminum or plastics, and positioned in the magnetic field of a permanent magnet. Also, the hollow cylinder or tube is connected to the diaphragm. When electrical current flows through the coil, a magnetic field is created around the hollow cylinder or tube that may either be attracted to or repelled by the magnetic field of the permanent magnet depending on the direction of the current flow. When the direction of current flow is reversed, the attractive or repulsion forces are also reversed. In this way, the hollow cylinder or tube can be moved back and forth, causing the diaphragm to move back and forth. This vibration creates the sounds that are produced by the loudspeaker.

SUMMARY

Loudspeaker drivers are described in the present disclosure. According to one embodiment, a loudspeaker driver comprises an acoustical diaphragm, a hollow cylinder or connection tube, first and second voice coils, and first and second magnet assemblies. The connection tube has a first section near a first end of the connection tube, a second section near a second end of the connection tube, and a middle section between the first section and second section. The first voice coil is connected to and surrounds at least a portion of the first section of the connection tube. The first voice coil has a first audio lead and a second audio lead. The second voice coil is connected to and surrounds at least a portion of the second section of the connection tube. The second voice coil has a first audio lead and a second audio lead. The first magnet assembly is configured to suspend the first voice coil in a first magnetic field and the second magnet assembly is configured to suspend the second voice coil in a second magnetic field. The connection tube intersects the acoustical diaphragm and the middle section of the connection tube is connected to the acoustical diaphragm.

According to another aspect of the present disclosure, a loudspeaker assembly is provided. The speaker assembly includes a first speaker including: a first frustoconical frame section configured to support a first acoustical diaphragm; a first voice coil coupled to the first acoustical diaphragm, the first voice coil having a first positive audio lead and a second negative audio lead; and a first magnet assembly configured to suspend the first voice coil in a first magnetic field, the first magnet assembly coupled to the first frustoconical frame section. The loudspeaker assembly further includes a second speaker including: a second frustoconical frame section configured to support a second acoustical diaphragm; a second voice coil coupled to the second acoustical diaphragm, the second voice coil having a first positive audio lead and a second negative audio lead; and a second magnet assembly configured to suspend the second voice coil in a second magnetic field, the second magnet assembly coupled to the second frustoconical frame section. An audio signal driver electrically is coupled to each of the first and second voice coils, wherein the first and second voice coils are wired in opposite polarity such that the first and second acoustical diaphragms vibrate in unison. In one aspect, the first and second speakers are arranged with a wide end of the first and second frustoconical frame sections respectively facing each other.

BRIEF DESCRIPTION OF THE DRAWING

The above and other aspects, features, and advantages of the present disclosure will become more apparent in light of the following detailed description when taken in conjunction with the accompanying drawings.

Figure 1:
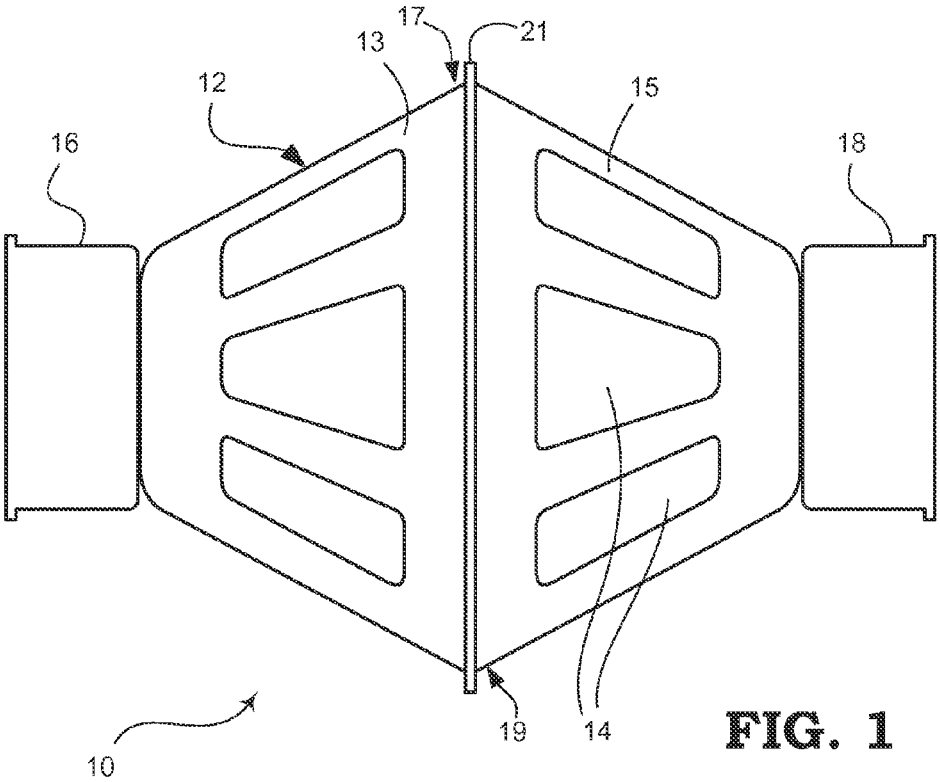
FIG. 1 is a side view of a loudspeaker driver, according to various implementations of the present disclosure.

To facilitate understanding, identical reference numerals have been used wherever possible to designate identical elements that are common to the figures. The images in the drawings are simplified for illustrative purposes and are not necessarily drawn to scale. The appended drawings illustrate exemplary embodiments of the present disclosure and, as such, should not be considered as limiting the scope of the disclosure that may admit to other equally effective embodiments. Correspondingly, it has been contemplated that features or steps of one embodiment may beneficially be incorporated in other embodiments without further recitation.

DETAILED DESCRIPTION

The present description illustrates the principles of the present disclosure. It will thus be appreciated that those skilled in the art will be able to devise various arrangements that, although not explicitly described or shown herein, embody the principles of the disclosure and are included within its spirit and scope.

All examples and conditional language recited herein are intended for pedagogical purposes to aid the reader in understanding the principles of the disclosure and the concepts contributed by the inventor to furthering the art, and are to be construed as being without limitation to such specifically recited examples and conditions.

Moreover, all statements herein reciting principles, aspects, and embodiments of the disclosure, as well as specific examples thereof, are intended to encompass both structural and functional equivalents thereof. Additionally, it is intended that such equivalents include both currently known equivalents as well as equivalents developed in the future, i.e., any elements developed that perform the same function, regardless of structure.

FIG. 1 is a side view of an embodiment of a loudspeaker driver 10. According to various implementations of the present disclosure, the loudspeaker driver 10 comprises a frame 12 having holes 14 or apertures. Since the frame 12 surrounds and protects the internal components of the loudspeaker driver 10, particular the components that generate sound, the holes 14 allow the audio waves to escape in numerous directions. In this respect, the loudspeaker driver 10 described in the present disclosure may be referred to as an omni-directional speaker. As illustrated, the frame 12 may comprise two symmetrical sections 13, 15, such as, for example, frustoconical sections. These two sections 13, 15 may be arranged with their wide ends 17, 19 respectively facing each other and connected to each other along barrier 21, as shown. In other embodiments, the frame 12 may include any other suitable shape. Also, the frame 12 may be configured with any suitable size, depending on size limitations and/or desired frequency response characteristics. The loudspeaker driver 10 also includes a first magnet assembly 16 and a second magnet assembly 18. Each magnet assembly 16 and 18 may include at least one permanent magnet for creating a magnetic field. The magnetic fields created by the first and second magnet assemblies 16 and 18 may be arranged such that the north and south poles are aligned (attracting), or, in alternative embodiments, the magnetic fields may be arranged such that the north and south poles thereof are opposed (repelling).

Figure 2:
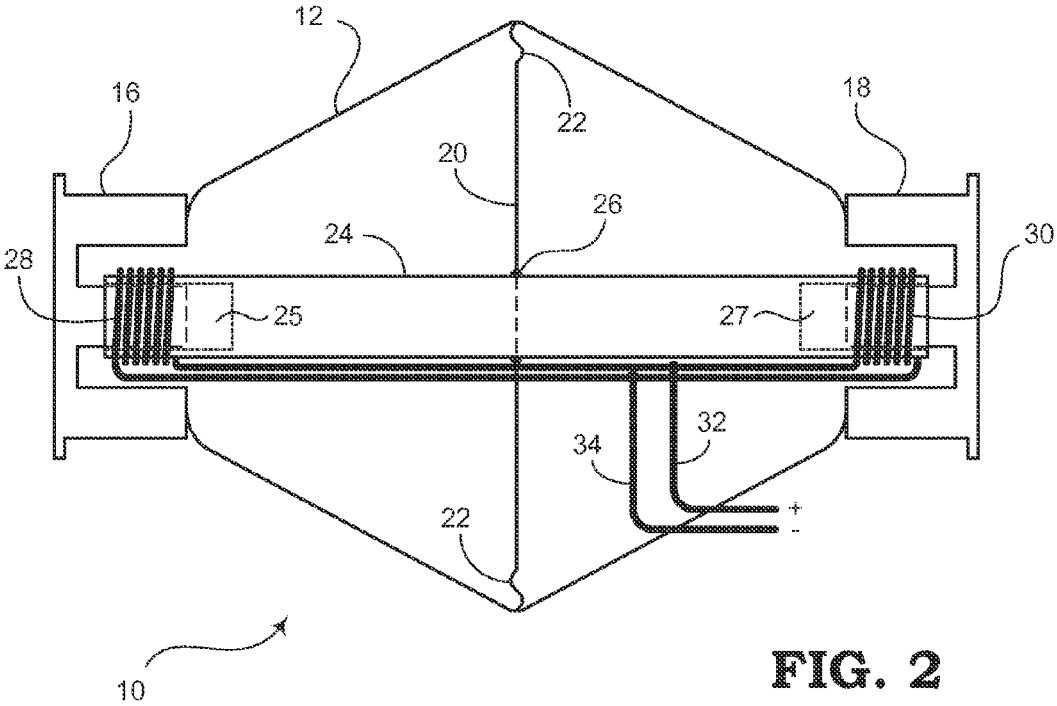
FIG. 2 is a cutaway view of the loudspeaker driver of FIG. 1, according to various implementations of the present disclosure.

FIG. 2 is a cutaway view of the loudspeaker driver 10 of FIG. 1. According to various implementations of the present disclosure, the loudspeaker 10 further comprises a diaphragm 20 or other type of membrane. It should be noted that the diaphragm 20 may comprise any suitable material. The diaphragm 20 may be planar and held in a substantially vertical position, as shown. The diaphragm 20 may be connected to the frame 12 by a suspension 22. In some embodiments, the suspension 22 may be omitted and the diaphragm 20 may instead be connected directed to the frame 12. The suspension 22, when present in various embodiments, may be a ring suspension that surrounds the outside edge of the diaphragm 20. The suspension 22 holds the diaphragm 20 in place and allows the diaphragm 20 to vibrate for the purpose of creating audio waves. It should be noted that because of the particular structure of the substantially planar diaphragm 20 instead of a conventional cone-shaped membrane, the suspension 22 is sufficient to support the diaphragm 20 without the need for additional suspension mechanisms, such as "spider" suspension elements.

The loudspeaker driver 10 also comprises a connection tube 24, which spans from the first magnet assembly 16 to the second magnet assembly 18. The connection tube 24 may be made of such material as paper, aluminum, plastics, etc. In some embodiments, the connection tube 24 may include hollow ends. In this way, the connection tube 24 can be kept in place by a post 25, 27 protruding from each of the magnet assemblies 16, 18, respectively. The connection tube 24 may be configured to slide along the posts 25, 27. Slits may be formed in the sides of the posts and inside portions of the connection tube 24 in order to prevent air pockets from forming in the hollow ends.

It is to be appreciated that the connection tube 24 may take other forms, for example, as a connection member, cylindrical solid member, a rod, etc.

The connection tube 24 is inserted through a hole in the diaphragm 20. In some embodiments, half of the connection tube 24 may be positioned on one side of the diaphragm 20 while the other half is positioned on the other side. Also, the connection tube 24 may be arranged such that its axis is perpendicular to the plane of the diaphragm 20. In addition, the connection tube 24 may protrude through or intersect the center of the diaphragm 20. The connection tube 24 is also configured to be coupled to the diaphragm 20 at an intersecting area, and may be adhered to the diaphragm 20 by any suitable type of adhesive 26 at the intersecting area. According to some embodiments, the adhesive 26 may be a bead of glue, or other suitable adhesive material, which may be formed in a ring around the outside of the connection tube 24.

In addition, the loudspeaker driver 10 comprises a first voice coil 28 and a second voice coil 30. The first and second voice coils 28 and 30 comprise electrical wires with insulation material surrounding the wires. The first voice coil 28 is wound around a first end of the connection tube 24 and the second voice coil 30 is wound around a second end of the connection tube 24. Not only are the voice coils 28 and 30 wrapped around the connection tube 24, but they are also connected to the connection tube 24 such that movement of the voice coils 28 and 30 due to magnetic forces in turn provides movement of the connection tube 24.

As shown, the voice coils 28 and 30 may be wound in the same direction. However, in other embodiments, the voice coils 28 and 30 may be wound in opposite directions from each other. One end of each of the voice coils 28 and 30 is coupled to a first audio lead 32, which is designated as a positive ("+") lead. The other end of each of the voice coils 28 and 30 is coupled to a second audio lead 34, which is designated as a negative ("−") lead. The positive and negative leads may also be referred to by the color of their electrical wires, such as black and red leads. As shown, an audio lead from one voice coil is connected to a specific audio lead from the other voice coil. However, according to some embodiments, the audio lead from the one voice coil may be connected to the other audio lead from the other voice coil. The specific design depends primarily on the orientation of the poles (i.e., north pole and south pole) of the two magnetic fields generated by the permanent magnets of the first and second magnet assemblies 16 and 18.

The magnet assemblies 16 and 18 may each comprise one or more permanent magnets arranged to create a permanent magnetic field in a general direction with respect to the ends of the connection tube 24. For example, according to some embodiments, the permanent magnets may be ring magnets that surround the voice coils 28 and 30. In other embodiments, the permanent magnets may include other shapes and may be positioned along the axis of the connection tube 24. These or other arrangements may be used for creating a permanent magnetic field in a general direction with respect to a center point of the voice coils 28 and 30.

According to some embodiments, the loudspeaker driver 10 may simply comprise the acoustical diaphragm 20 and the connection tube 24 as shown in FIG. 2. The connection tube 24 may have a first section near a first end of the connection tube 24, a second section near a second end of the connection tube 24, and a middle section between the first section and second section. The loudspeaker driver 10 also includes the first voice coil 28 connected to and surrounding at least a portion of the first section of the connection tube 24, wherein the first voice coil 28 has a first audio lead and a second audio lead. The loudspeaker driver 10 also includes the second voice coil 30 connected to and surrounding at least a portion of the second section of the connection tube 24, wherein the second voice coil 30 has a first audio lead and a second audio lead. The loudspeaker driver 10 also includes the first magnet assembly 16 configured to suspend the first voice coil 28 in a first magnetic field and the second magnet assembly 18 configured to suspend the second voice coil 30 in a second magnetic field. The connection tube 24 intersects the acoustical diaphragm 20 and the middle section of the connection tube 24 is connected to the acoustical diaphragm 20.

According to additional embodiments, the loudspeaker driver 10 described above may be further configured such that the first magnet assembly 16 comprises a first permanent magnet and the second magnet assembly 18 comprises a second permanent magnet. For example, the first permanent magnet may be a ring magnet positioned around the first voice coil 28 and the second permanent magnet may be a ring magnet positioned around the second voice coil 30. The first magnet assembly 16 and second magnet assembly 18 may comprise alignment structures configured to enable the connection tube 24 to move along a substantially axial direction. For example, the axial direction may be defined as the direction of the axis of the connection tube 24. The loudspeaker driver 10 may further be defined such that the first voice coil 28 and second voice coil 30 are configured to simultaneously receive electrical signals causing the first voice coil 28 and second voice coil 30 to create cooperative forces on the connection tube 24, thereby causing the connection tube 24 to move back and forth along the substantially axial direction.

According to some embodiments, the loudspeaker driver 10 described above may further be defined such that the acoustical diaphragm 20 is substantially planar when at rest. For example, the acoustical diaphragm 20 may be at rest when there are no electrical signals provided to the loudspeaker driver 10. When electrical signals (e.g., audio signals) are received, the diaphragm 20 will vibrate in a way that causes sound waves to be radiated from the loudspeaker driver 10. In some implementations, the acoustical diaphragm 20 may have a circular shape, but according to other implementations, the diaphragm 20 may be square, rectangular, or any other suitable shape.

Furthermore, the loudspeaker driver 10 also comprises the frame 12, wherein the frame 12 may be configured to support the first magnet assembly 16 and second magnet assembly 18 and maintain a predetermined distance between them. Also, the loudspeaker driver 10 may comprise the suspension 22 (e.g., a ring suspension) configured to connect an edge of the acoustical diaphragm 20 with the frame 12. The suspension 22 may have any suitable shape depending on the corresponding shape or edge dimensions of the diaphragm 20. Also, the shape of the suspension 22 may also depend on the inside dimensions and shape of the frame 12. The frame 12 preferably comprises at least one hole 14 to expose the acoustical diaphragm 20 to the environment. The holes 14 allow the sound to radiate from the interior of the frame 12 out into the surrounding areas where listeners may hear the sound.

In addition, the loudspeaker driver is further defined such that the first audio lead of the first voice coil 28 is coupled to the first audio lead of the second voice coil 30 and the second audio lead of the first voice coil 28 is coupled to the second audio lead of the second voice coil 30. In this respect, the poles of the first magnetic field will be substantially aligned with poles of the second magnetic field. Therefore, the first voice coil 28 will provide a pushing force on the diaphragm 20 while the second voice coil 30 provides a pulling force, and the first voice coil 28 will provide a pulling force while the second voice coil 30 provides a pushing force. The forces in this case will be additive for moving the connection tube 24 in the same direction without the voice coils 28 and 30 working against each other.

In other embodiments, the first voice coil 28 and second voice coil 30 may be wound in the same direction around the connection tube 24, and the poles of the first magnetic field will be substantially opposed to poles of the second magnetic field. In other words the north poles will both be on the inside (or outside) and the south poles will both be on the outside (or inside). In this case, the first voice coil 28 and second voice coil 30 will be wound in opposite directions around the connection tube. Again, this arrangement also results in the forces being additive, such that the voice coils 28 and 30 will not be working against each other.

With two electromagnetic structures, as described herein, the force exerted on the diaphragm 20 can essentially be doubled. For instance, at any instance in the electrical signals, one voice coil provides a pushing force (i.e., toward a center region of the frame 12) on the connection tube 24 while the other voice coil provides a pulling force (i.e., away from the center region of the frame 12) on the connection tube 24. The result is a quick response and quick movement of the diaphragm 20, which increases the dynamic range of the loudspeaker driver 10. Since the diaphragm moves at high acceleration by both pull and push forces, the diaphragm transfers more effective power to the air in creating sound, i.e., high efficiency in power conversion of electricity to sound energy. Also, the dual push/pull voice coils can extend both the high and low frequency responses of the loudspeaker driver 10.

Furthermore, the symmetrical aspects of the loudspeaker driver 10 described in the present disclosure allow for better control of the diaphragm 20 thereby resulting in more accurate reproduction of audio signals. By providing push-pull forces on the diaphragm, the diaphragm's vibration more precisely follows the sound electrical signal, resulting in a higher definition sound reproduction than conventional drivers.

The teachings and principles of the present disclosure may be configured in various implementations to achieve a loudspeaker with increased dynamic range. In one embodiment, two conventional speakers may be coupled mouth to mouth, or, diaphragm to diaphragm, and wired in opposite polarity, such that the two diaphragm vibrates in unison. In such an embodiment, the two diaphragms simulate a single diaphragm. Such an implementation is illustrated in FIG. 3.

Figure 3:
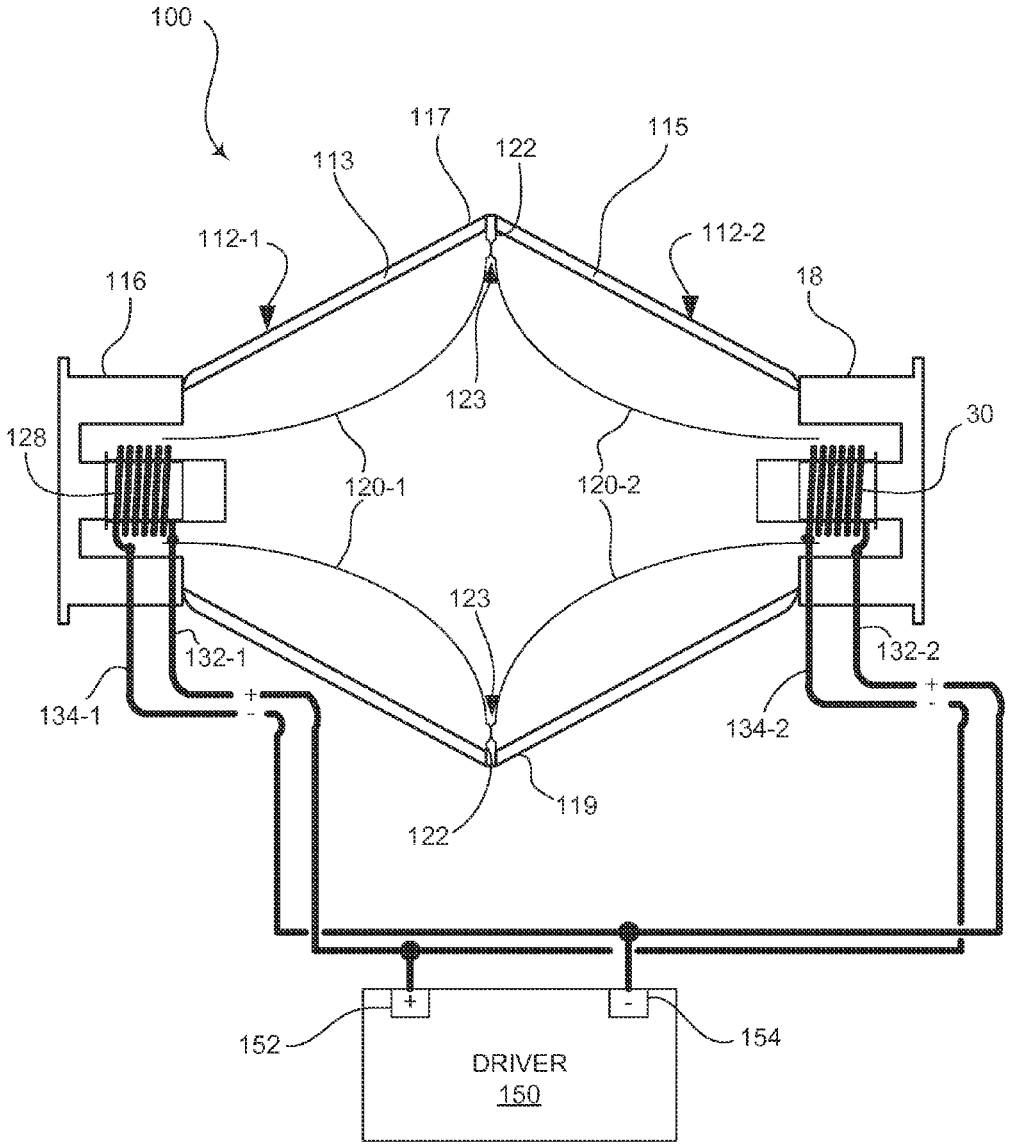
FIG. 3 is a cutaway view of a speaker assembly according to various implementations of the present disclosure.

Referring to FIG. 3, speaker assembly 100 includes a first and second speakers 112-1, 112-2. The first speaker 112-1 includes a frustoconical frame section 113 with a cone-shaped or frustoconical diaphragm 120-1 coupled to the frame section 113 by a suspension 122. The first speaker 112-1 further includes a magnet assembly 116 and a voice coil 128, as described above. Likewise, the second speaker 112-2 includes a frustoconical frame section 115 with a cone-shaped or frustoconical diaphragm 120-2 coupled to the frame section 115 by a suspension 122, a magnet assembly 118 and a voice coil 130. The first and second speakers are arranged with the wide ends 117, 119 of the frame sections 113, 115 respectively facing each other and so at least a portion of each diaphragm 120-1, 120-2 contact with each other, for example, at portion 123. It is to be appreciated that since each diaphragm 120-1, 120-2 has a cone or frustoconical shape, portion 123 is circular, and therefore, diaphragms 120-1, 120-2 come into contact with each other in a circular manner. In other embodiments, the diaphragm 120-1, 120-2 do not touch each other.

Speaker assembly 100 further includes an audio signal driver 150 for electrically driving the voice coils 128, 130 which includes a positive output 152 and a negative output 154. Exemplary audio signal drivers include an audio amplifier, receiver, etc., or any other known device for providing an electrical signal indicative of an audio signal. Each of the voice coils 128, 130 include a positive audio lead 132 and a negative audio lead 134. In this embodiment, the voice coils 128, 130 are wired in opposite polarity, such that the two diaphragm vibrates in unison. For example, positive audio lead 132-1 of voice coil 128 is connected to the positive output 152 of driver 150, while positive audio lead 132-2 of voice coil 130 is connected to the negative output 154 of driver 150. Similarly, negative audio lead 134-1 of voice coil 128 is connected to the negative output 154 of driver 150, while negative audio lead 134-2 of voice coil 130 is connected to the positive output 152 of driver 150. In this respect, the first voice coil 128 will provide a pushing force on the diaphragm 120-1 while the second voice coil 130 provides a pulling force on the diaphragm 120-2, and the first voice coil 128 will provide a pulling force while the second voice coil 130 provides a pushing force. In this manner, the two diaphragms 120-1, 120-2 vibrate in unison and simulate a single diaphragm.

It is to be appreciated that the various features shown and described are interchangeable, that is a feature shown in one embodiment may be incorporated into another embodiment.

Although the disclosure herein has been described with reference to particular illustrative embodiments, it is to be understood that these embodiments are merely illustrative of the principles and applications of the present disclosure. Therefore numerous modifications may be made to the illustrative embodiments and other arrangements may be devised without departing from the spirit and scope of the present disclosure, which is defined by the appended claims.

What is claimed is:

1. A loudspeaker assembly comprising:

a first speaker including:

a first frustoconical frame section configured to support a first acoustical diaphragm;

a first voice coil coupled to the first acoustical diaphragm, the first voice coil having a first positive audio lead and a second negative audio lead; and a first magnet assembly configured to suspend the first voice coil in a first magnetic field, the first magnet assembly coupled to the first frustoconical frame section;

a second speaker including:

a second frustoconical frame section configured to support a second acoustical diaphragm;

a second voice coil coupled to the second acoustical diaphragm, the second voice coil having a first positive audio lead and a second negative audio lead; and a second magnet assembly configured to suspend the second voice coil in a second magnetic field, the second magnet assembly coupled to the second frustoconical frame section; and an audio signal driver electrically coupled to each of the first and second voice coils, wherein the first and second voice coils are wired in opposite polarity such that the first and second acoustical diaphragms vibrate in unison;

wherein at least a portion of an edge of the first acoustical diaphragm contacts at least a portion of an edge of the second acoustical diaphragm and is coupled directly to at least the portion of the edge of the second acoustical diaphragm;

wherein the audio signal driver provides signals to the first voice coil to create a first vibration force that is directly applied to the first acoustical diaphragm;

wherein the first vibration force is transferred to the second acoustical diaphragm essentially through the portion of the edge of the first acoustical diaphragm mechanically transferring the first vibration force to the portion of the edge of the second acoustical diaphragm;

wherein the audio signal driver provides signals to the second voice coil to create a second vibration force that is directly applied to the second acoustical diaphragm; and wherein the second vibration force is transferred to the first acoustical diaphragm essentially through the portion of the edge of the second acoustical diaphragm mechanically transferring the second vibration force to the portion of the edge of the first acoustical diaphragm.

2. The speaker assembly of claim 1, wherein the first and second speakers are arranged with a wide end of the first and second frustoconical frame sections respectively facing each other.

3. The loudspeaker assembly of claim 1, wherein a wide end of the first frustoconical frame section of the first speaker is coupled to a wide end of the second frustoconical frame section of the second speaker in a face to face arrangement.

4. The loudspeaker assembly of claim 1, wherein the first magnet assembly is physically separated from the second magnet assembly.

5. The loudspeaker assembly of claim 1, wherein the first acoustical diaphragm and the second acoustical diaphragm have a frustoconical shape.

6. The loudspeaker assembly of claim 5, wherein a periphery of a wide end of the first acoustical diaphragm is coupled to a periphery of a wide end of the second acoustical diaphragm.

7. A loudspeaker assembly comprising:

a first speaker having a first frame section, a first acoustical diaphragm, and a first voice coil coupled to the first acoustical diaphragm; and a second speaker having a second frame section, a second acoustical diaphragm, and a second voice coil coupled to the second acoustical diaphragm;

wherein the first frame section includes a first peripheral edge forming an opening and the second frame section includes a second peripheral edge forming an opening;

wherein the first peripheral edge of the first frame section is coupled to the second peripheral edge of the second frame section such that the first acoustical diaphragm of the first speaker faces the second acoustical diaphragm of the second speaker;

wherein at least a portion of an edge of the first acoustical diaphragm contacts at least a portion of an edge of the second acoustical diaphragm and is coupled to at least the portion of the edge of the second acoustical diaphragm;

wherein the first voice coil is configured to create a first vibration force that is directly applied to the first acoustical diaphragm;

wherein the first vibration force is transferred to the second acoustical diaphragm essentially through the portion of the edge of the first acoustical diaphragm mechanically transferring the first vibration force to the portion of the edge of the second acoustical diaphragm;

wherein the second voice coil is configured to create a second vibration force that is directly applied to the second acoustical diaphragm; and wherein the second vibration force is transferred to the first acoustical diaphragm essentially through the portion of the edge of the second acoustical diaphragm mechanically transferring the second vibration force to the portion of the edge of the first acoustical diaphragm.

8. The loudspeaker assembly of claim 7, wherein the first speaker further includes a first magnet coupled to the first frame section and the second speaker further includes a second magnet coupled to the second frame section, and wherein the first magnet is configured to suspend the first voice coil in a first magnetic field and the second magnet is configured to suspend the second voice coil in a second magnetic field.

9. The loudspeaker assembly of claim 7, wherein the first and second acoustical diaphragms are configured to vibrate substantially in unison.

10. The loudspeaker assembly of claim 7, wherein the first magnet is directed away from the second speaker and the second magnet is directed away from the first speaker.

11. The loudspeaker assembly of claim 7, wherein each of the first and second acoustical diaphragms has a substantially frustoconical shape.

12. The loudspeaker assembly of claim 7, wherein the entire edge of the first acoustical diaphragm contacts and is coupled to the entire edge of the second acoustical diaphragm.

13. A method of manufacturing a loudspeaker assembly, the method comprising the steps of:

providing a first speaker having at least a first frame section and a first acoustical diaphragm;

providing a second speaker having at least a second frame section and a second acoustical diaphragm;

arranging the first speaker and second speaker in a face-to-face relationship;

coupling a first peripheral edge of the first frame section with a second peripheral edge of the second frame section such that at least a portion of an edge of the first acoustical diaphragm contacts at least a portion of an edge of the second acoustical diaphragm; and coupling at least the portion of the edge of the first acoustical diaphragm with at least the portion of the edge of the second acoustical diaphragm;

wherein a first vibration force applied directly to the first acoustical diaphragm is transferred to the second acoustical diaphragm essentially through the portion of the edge of the first acoustical diaphragm mechanically transferring the first vibration force to the portion of the edge of the second acoustical diaphragm; and wherein a second vibration force applied directly to the second acoustical diaphragm is transferred to the first acoustical diaphragm essentially through the portion of the edge of the second acoustical diaphragm mechanically transferring the second vibration force to the portion of the edge of the first acoustical diaphragm.

14. The method of claim 13, wherein the first speaker further includes a first voice coil coupled to the first acoustical diaphragm and a first magnet coupled to the first frame section, and wherein the second speaker further includes a second voice coil coupled to the second acoustical diaphragm and a second magnet coupled to the second frame section.

15. The method of claim 14, wherein the first magnet is configured to suspend the first voice coil in a first magnetic field and the second magnet is configured to suspend the second voice coil in a second magnetic field.

16. The method of claim 14, wherein the step of arranging the first speaker and second speaker further includes directing the first magnet and second magnet away from each other.

17. The method of claim 13, wherein the first acoustical diaphragm is a truncated cone having a wide end forming the edge of the first acoustical diaphragm and the second acoustical diaphragm is a truncated cone having a wide end forming the edge of the second acoustical diaphragm.

18. The method of claim 17, wherein the step of coupling at least a portion of the edge of the first acoustical diaphragm with at least a portion of the edge of the second acoustical diaphragm includes the step of coupling the entire edge of the first acoustical diaphragm with the entire edge of the second acoustical diaphragm.

* * * * *